US005842918A

United States Patent [19]

Cowen

[11] Patent Number: 5,842,918

[45] Date of Patent: Dec. 1, 1998

[54] ADJUSTABLE CHIMNEY COVER

[75] Inventor: Calvin A. Cowen, 350 Bridgeport Dr., West Union, S.C. 29696

[73] Assignee: Calvin A. Cowen, West Union, S.C.

[21] Appl. No.: 822,676

[22] Filed: Mar. 24, 1997

[51] Int. Cl.[6] ..... F23L 17/12

[52] U.S. Cl. ..... 454/12; 454/3

[58] Field of Search ..... 454/3, 12, 32

[56] References Cited

U.S. PATENT DOCUMENTS

| | | | |
|---|---|---|---|
| 850,126 | 4/1907 | Bayley | 454/12 |
| 850,372 | 4/1907 | Kemp | 454/12 X |
| 874,249 | 12/1907 | Rothbarth | 454/12 |
| 1,563,706 | 12/1925 | Hoffland | 454/12 X |
| 2,536,235 | 1/1951 | Steelman et al. | 454/12 |
| 4,202,255 | 5/1980 | McNamara . | |
| 4,325,291 | 4/1982 | Paynton et al. . | |
| 4,334,460 | 6/1982 | Simmons et al. . | |
| 4,543,754 | 10/1985 | Cekala | 52/218 |
| 4,697,500 | 10/1987 | Hisey . | |
| 4,732,078 | 3/1988 | Giumenta et al. . | |
| 4,777,871 | 10/1988 | Stowell . | |
| 5,025,712 | 6/1991 | Perry . | |

*Primary Examiner*—Harold Joyce

*Attorney, Agent, or Firm*—Thomas, Kayden, Horstemeyer & Risley, L.L.P.

[57] ABSTRACT

An adjustable chimney cover is provided which can be adjusted in length and width to accommodate any size chimney. The chimney cover is comprised of a plurality of subassemblies, each of which comprises two side panels and a middle panel. The first ends of the side panels are movably mounted within a guide structure formed in the middle panel to allow the side panels to slide in first and second directions within the guide structure. The overall length of the subassemblies can be adjusted by sliding the panels in the first or second directions. Once the length of the subassemblies has been fixed, the side panels are locked in place. The subassemblies are then placed in an overlapping relationship and adjacent side panels are attached at their second ends. The second ends of the side panels are then attached to a chimney. In order to adjust the width of the chimney cover, additional side panels are used and/or the amount of overlap between the subassemblies is adjusted. Preferably, the second ends of adjacent side panels are attached by weaving a strap through slots formed in the second ends of the side panels and connecting the ends of the strap to a fastener which can adjusted to tighten the strap about the chimney.

23 Claims, 14 Drawing Sheets

ADJUSTABLE CHIMNEY COVER

TECHNICAL FIELD OF THE INVENTION

The present invention relates to an adjustable chimney cover and, more particularly, to a chimney cover comprised of a plurality of connectable elements which can be connected together in different configurations to provide a chimney cover which is adjustable in length and width for covering chimneys of several different sizes.

BACKGROUND OF THE INVENTION

Currently, there are no chimney covers in the market, to the Applicant's knowledge, that are capable of covering most sizes of chimneys. The chimney covers commonly found only fit on the chimney flue pipes that are standard size. Many chimneys, especially on older houses, were constructed without flue pipes. There are several sizes of standard flue pipes. Often, one chimney will have two or more flue pipes. In this case, two or more conventional chimney covers would be needed.

Many covers for chimneys and flues are welded or riveted units that cannot be stored disassembled due to the difficulty that would be encountered by consumers in attempting to assemble these chimneys covers. Since these chimney covers come fully assembled, the containers in which they are sold contain a large amount of empty space. Therefore, these types of chimney covers occupy a great deal of valuable shelf space in stores. Also, because chimneys are of many different sizes, stores often must carry several different sizes of the same type of chimneys covers, which further reduces the amount of shelf space which may be allocated for other products.

As mentioned above, most chimney covers can only attach to a chimney with a flue pipe. The present invention provides a chimney cover which can be attached to almost any chimney. The method of the present invention for attaching the chimney cover of the present invention requires only one easily manufactured feature and some standard, inexpensive hardware. Furthermore, the attachment method of the present invention allows for attachment to a large range of chimneys for a minimal cost.

Accordingly, a need exists for an adjustable chimney cover comprised of components which can be easily assembled and adjusted to provide a chimney cover suitable for covering any size chimney.

SUMMARY OF THE INVENTION

In accordance with the present invention, an adjustable chimney cover is provided which is adjustable in length and width to fit any size chimney. The chimney cover is comprised of at least two subassemblies. Each subassembly is comprised of at least two panels which are fastened together by a locking mechanism, such as nuts and bolts, adhesive strips, glue, clips or locking pins. The side panels of each subassembly are fastened together at a location where the side panels of the subassembly overlap to achieve an overall length of the subassembly. The subassemblies are fastened together and to a chimney top by a fastening mechanism such that the subassemblies are placed in a partially overlapping relationship with one another to form a chimney cover having a width approximately equal to the length of the subassemblies. The length of the chimney cover can be varied by varying the amount of overlap between adjacent subassemblies and/or by varying the number of subassemblies.

Preferably, the fastening mechanism comprises a strap which is woven through slots located in one end of each of the side panels after the slotted ends of the side panels have been disposed about a chimney top. The ends of the strap are attached to a fastening device comprised by the fastening mechanism. The fastening device can be adjusted to tighten the strap about the chimney cover. The overall length of the chimney cover can be varied by adjusting the amount of overlap between the subassemblies.

In accordance with an alternative embodiment of the present invention, each subassembly comprises a middle panel and two side panels. The side panels may be attached to one another in the manner discussed above to obtain a subassembly having a desired overall length. The subassemblies may be attached to one another and to the chimney top in the manner discussed above.

In accordance with the preferred embodiment of the present invention, each subassembly is comprised of a middle panel and two side panels. The side panels of each subassembly are movably mounted within the middle panel of the subassembly to allow the side panels to be adjusted in first and second directions within the middle panel. The overall length of the subassembly can be adjusted by sliding the side panels in the first or second directions within the middle panel. The subassemblies each comprise a locking mechanism for locking the first and second side panels in position once the first and second side panels have been adjusted to obtain a desired overall length of the third subassembly. Preferably, this is accomplished by crimping tabs on the middle panel about the side panels. In order to adjust the length of the chimney top, the amount of overlap between the subassemblies and/or the number of subassemblies is varied. In accordance with this embodiment, the subassemblies are attached to a chimney top in the manner discussed above.

Thus, in accordance with the present invention, the length of the chimney cover is adjusted by increasing or decreasing the number of subassemblies used to construct the chimney cover, and/or by adjusting the amount of overlap between adjacent subassemblies. The width of the chimney cover is adjusted by adjusting the positions of the side panels of the subassemblies relative to the middle panels.

DETAILED DESCRIPTION OF THE INVENTION

Figure 1:
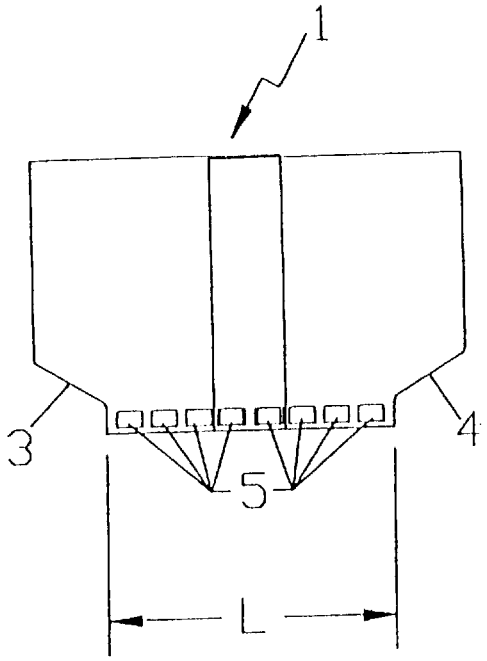
FIG. 1 is a front view of the chimney cover of the present invention in accordance with a first embodiment.

FIG. 1 is a front view of the chimney cover 1 of the present invention in accordance with a first embodiment which illustrates how the chimney cover 1 would appear as installed about a chimney opening (not shown). The chimney cover 1 is comprised of at least two subassemblies 3 and 4 which are fastened together in an overlapping relationship, as indicated by the dashed lines. As discussed in more detail below, the amount of overlap between the subassemblies 3 and 4 can be altered and/or the number of subassemblies utilized to construct the chimney cover can be varied in order to adjust the length L of the chimney cover. In accordance with the preferred embodiment of the present invention, each of the subassemblies 3 and 4 have openings 5 formed in the ends thereof. In order to connect the subassemblies 3 and 4 together after they have been placed in the overlapping relationship with one another, preferably a strap (not shown) is woven through the openings 5 and then tightened about the base of the chimney opening. The ends of the strap are then fixed in place to hold the chimney cover about the base of the chimney opening (not shown). The manner in which the subassemblies are connected together and the manner in which the chimney cover is fastened about the chimney opening will be discussed in more detail below.

Figure 2:
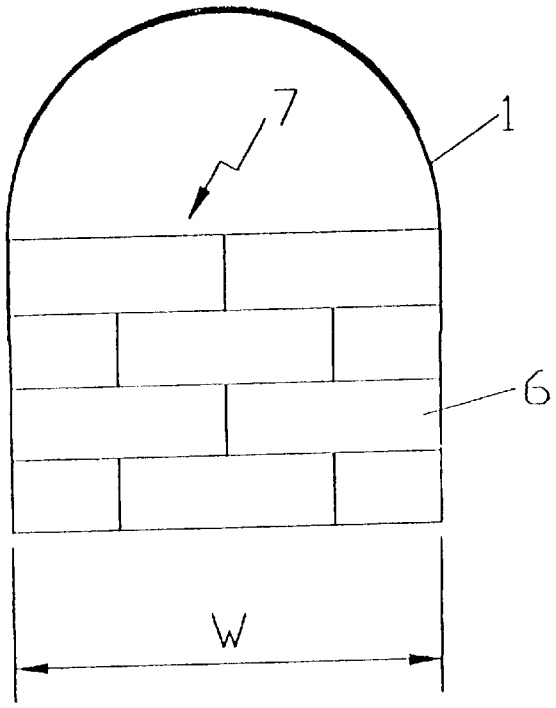
FIG. 2 is a side view of the chimney cover of the present invention fastened about a chimney opening of a chimney having width W.

FIG. 2 is a side view of the chimney cover 1 of the present invention fastened about a chimney opening 7 of a chimney 6 having width W. As discussed in detail below, the chimney cover 1 is comprised of sections which can be adjusted relative to one another in order to adjust the width of the chimney cover 1 to a width W suitable for covering a chimney of any width. The manner in which the width of the chimney cover is adjusted is discussed in detail below.

Figure 3A:
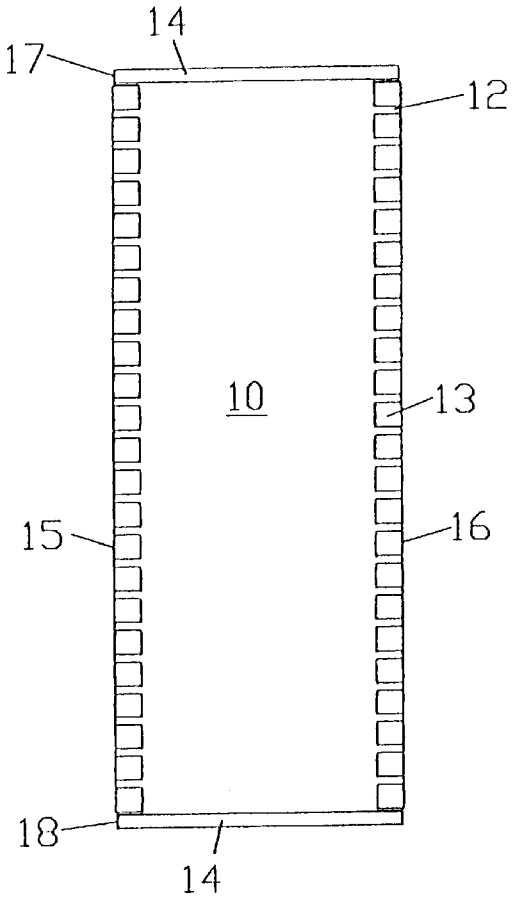
FIG. 3A illustrates a bottom plan view of the middle panel of a first subassembly utilized in constructing the chimney cover of the present invention.
Figure 3B:
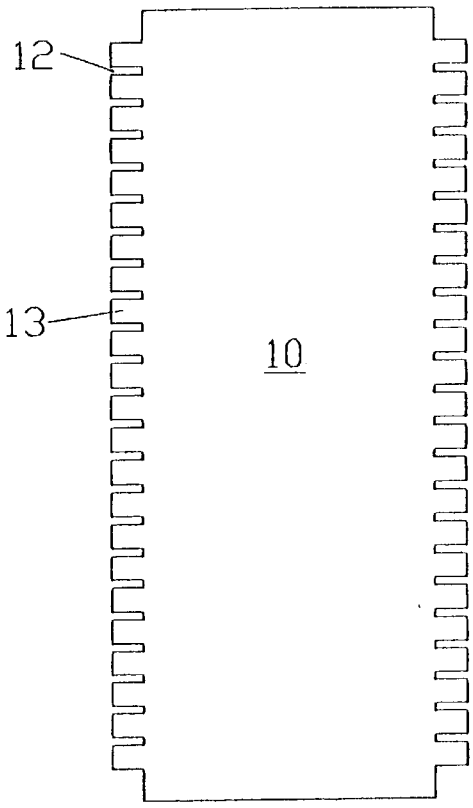
FIG. 3B illustrates a top plan view of the middle panel of the subassembly shown in FIG. 3A before the tabs have been bent inwards.

FIG. 3A illustrates a bottom plan view of the middle panel 10 of a first subassembly utilized in constructing the chimney cover of the present invention. FIG. 3B illustrates a top plan view of the middle panel 10 shown in FIG. 3A before the tabs have been bent inwards. The middle panel 10 has notches 12 formed therein which allow the middle panel 10 to be bent into an arc of a desired shape (see FIG. 2) without buckling to accommodate a chimney opening (not shown) of a particular size. The chimney cover of the present invention, including middle panel 10, is preferably constructed of light gauge sheet metal, such as aluminum, galvanized steel, or stainless steel. However, it should be noted that the present invention is not limited with respect to the type of material used to construct the chimney cover of the present invention. The material should have sufficient mechanical stability to withstand the forces which chimney covers normally must be capable of withstanding, and should have sufficient flexibility to allow it to be bent as necessary during assembly and installation of the chimney cover. In accordance with the present invention, it has been determined that sheet metal is suitable for this purpose.

Figure 4:
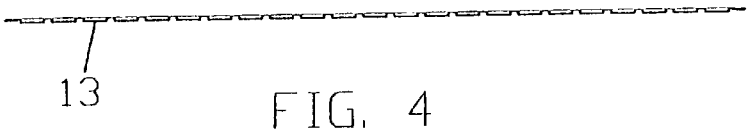
FIG. 4 illustrates a side view of the middle panel of the subassembly shown in FIG. 3B which shows the manner in which tabs on the middle panel are bent to form the channels.

When the notches 12 are formed in the middle panel 10, tabs 13 are created. The tabs 13 are bent inward to form a channel on the left and right sides 15 and 16, respectively, of the middle panel 10, as shown in FIGS. 3A and 4. FIG. 3B shows the middle panel 10 before the tabs 13 have been bent inwards to form the channels. When the side panels (FIGS. 5A and 5B) are inserted into the channels at the first and second ends 17 and 18, respectively, of the middle panel 10, as discussed in detail below, the channels function as guides which allow the side panels to be adjusted forward and backward with respect to the ends 17 and 18 of the middle panel 10. FIG. 4 illustrates a side view of the middle panel 10 which shows the manner in which the tabs 13, once bent, form the channels.

Figure 5A:
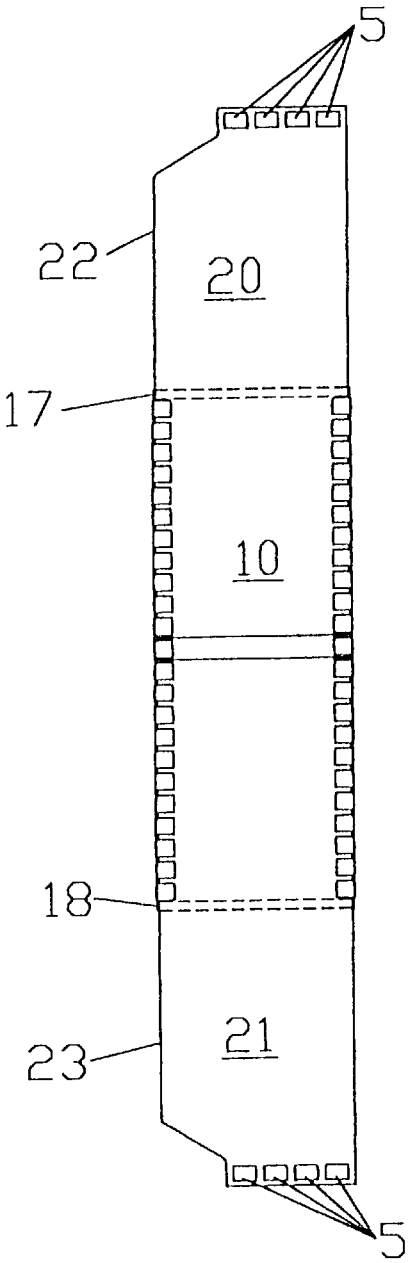
FIGS. 5A and 5B illustrate plan views of the middle panel of FIG. 4 and the side panels mounted therein.
Figure 5B:
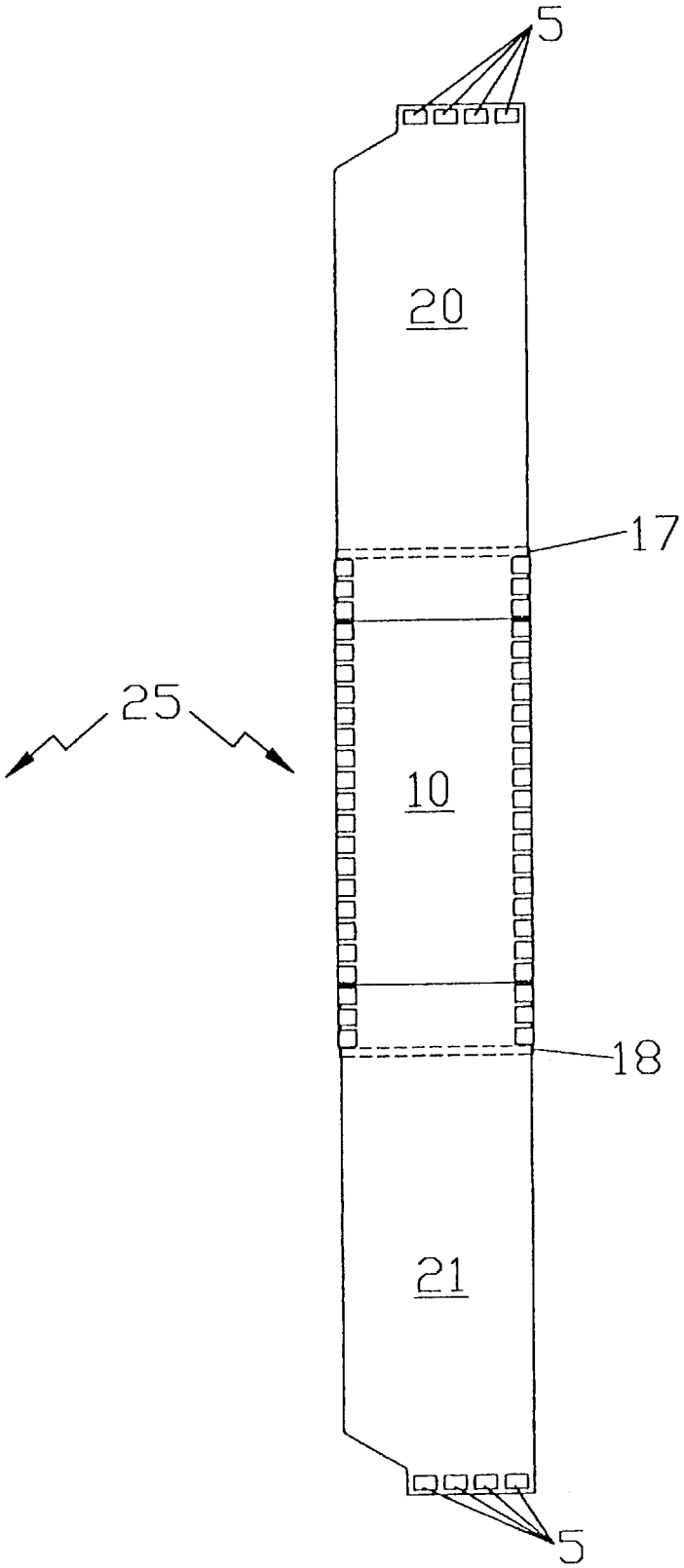

FIGS. 5A and 5B illustrate plan views of the middle panel 10 and side panels 20 and 21 comprising the subassembly of the present invention in accordance with a preferred embodiment. Once the side panels 20 and 21 have been inserted into the middle panel 10, a subassembly 25 is created. As discussed above with respect to FIG. 1, at least two of these subassemblies are connected together to construct the chimney cover of the present invention. FIGS. 5A and 5B demonstrate the manner in which the side panels 20 and 21 can be adjusted within the channels formed by tabs 13 of middle panel 10 by sliding the side panels 20 and 21 forward or backward within the channels relative to the ends 17 and 18 of middle panel 10. Once the side panels have been inserted a desired distance to form a subassembly of a desired length, the tabs 13 are crimped to hold the side panels 20 and 21 in place. The subassembly 25 shown in FIG. 5A has a greater length than the subassembly 25 shown in FIG. 5B and, therefore, is capable of covering a chimney of a greater width than that which can be covered by the subassembly of FIG. 5B.

Figure 6:
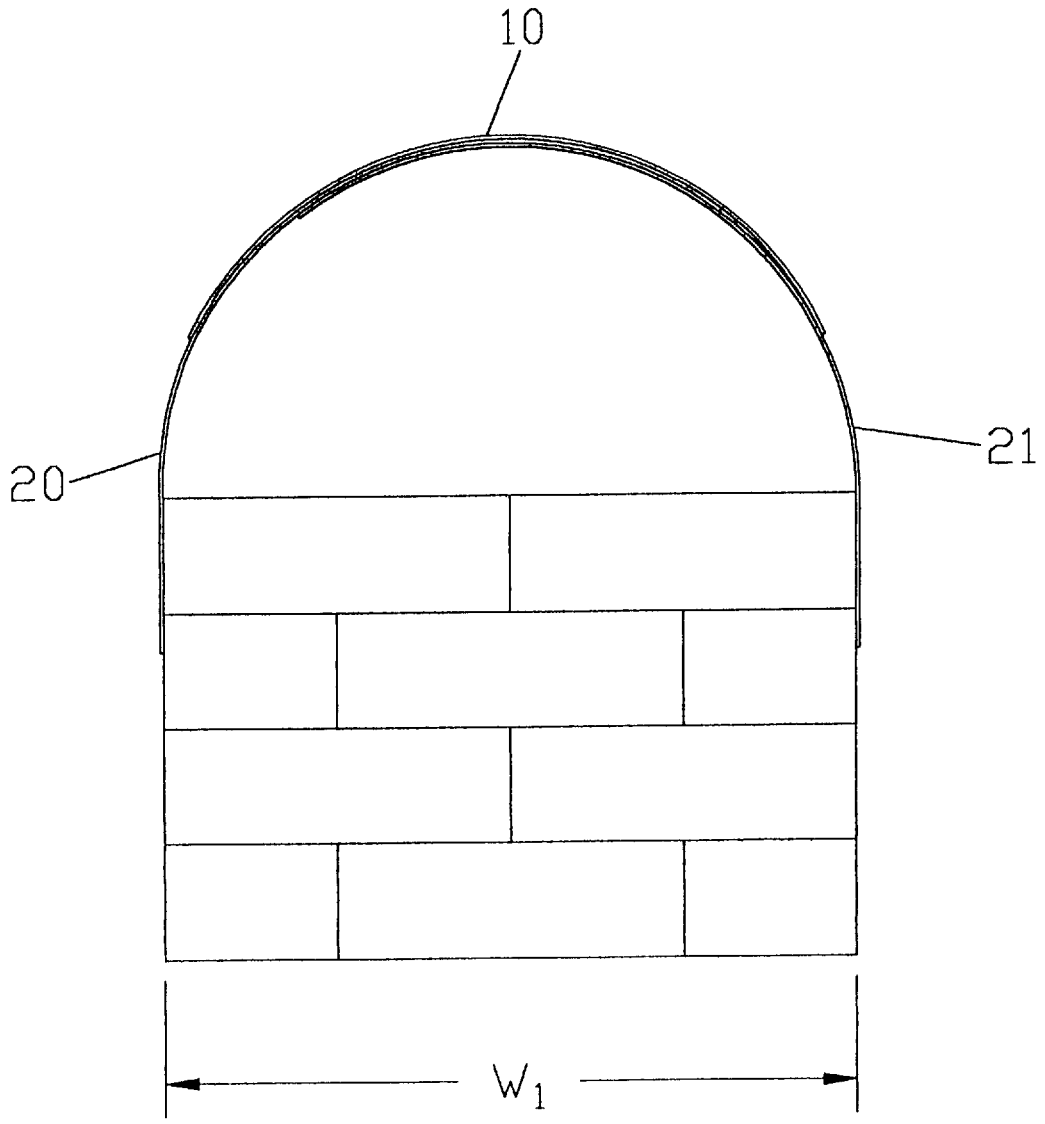
FIGS. 6 and 7 illustrate side views of two chimneys of different widths having the adjustable chimney cover of the present invention attached thereto.
Figure 7:
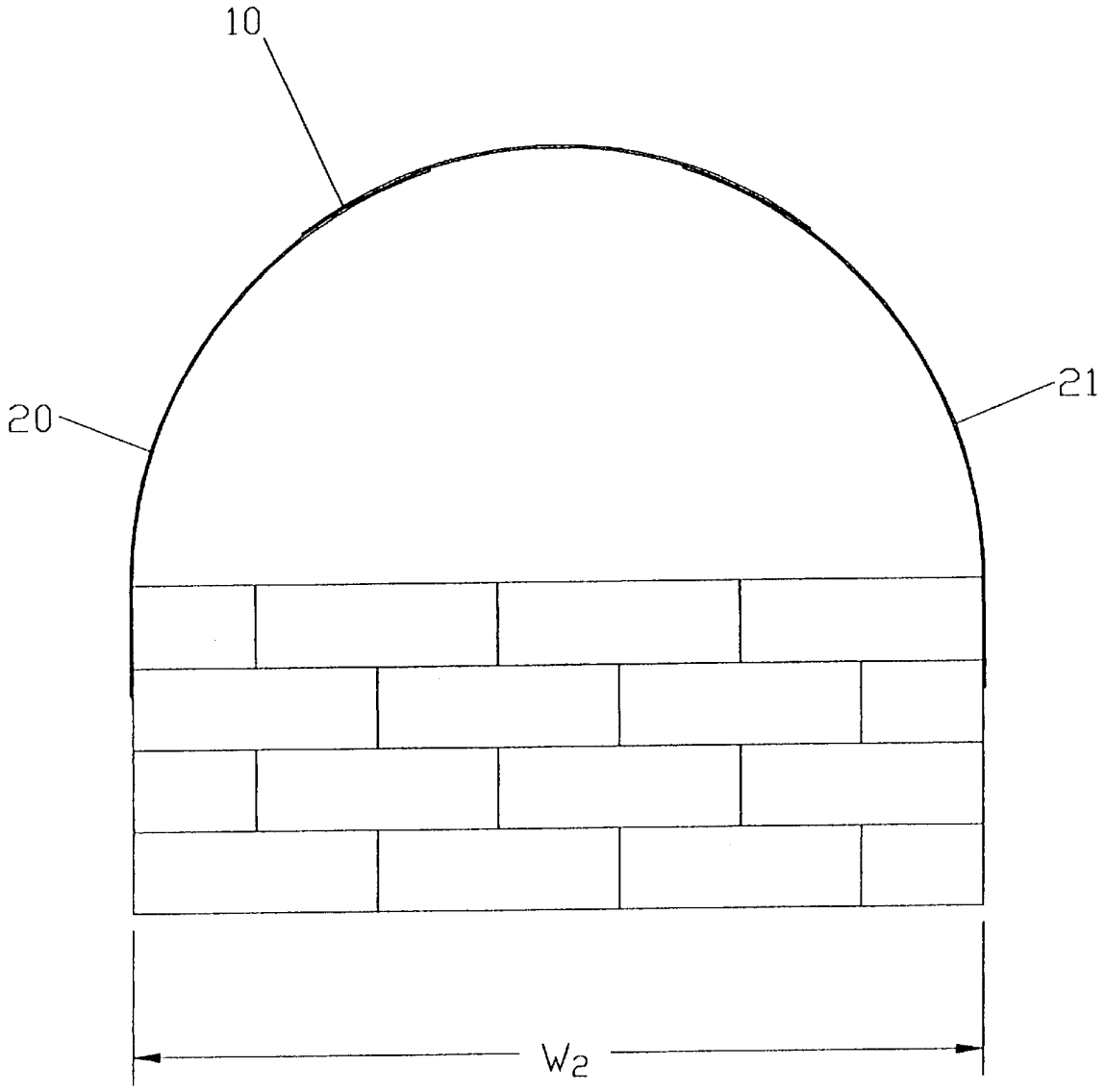

FIGS. 6 and 7 illustrate side views of two chimneys of different widths having the adjustable chimney cover of the present invention attached thereto. The chimney shown in FIG. 6 has a width $W_1$ which is less the width $W_2$ of the chimney shown in FIG. 7. As shown in FIG. 6, the side panels 20 and 21 slide inside of middle panel 10. The side panels 20 and 21 are inserted into middle panel 10 until side panel 20 overlaps side panel 21. In contrast, in order to accommodate the larger chimney shown in FIG. 7, the side panels 20 and 21 shown in FIG. 7 do not overlap but are only inserted far enough into the middle panel 10 to cover the chimney opening.

Figure 8:
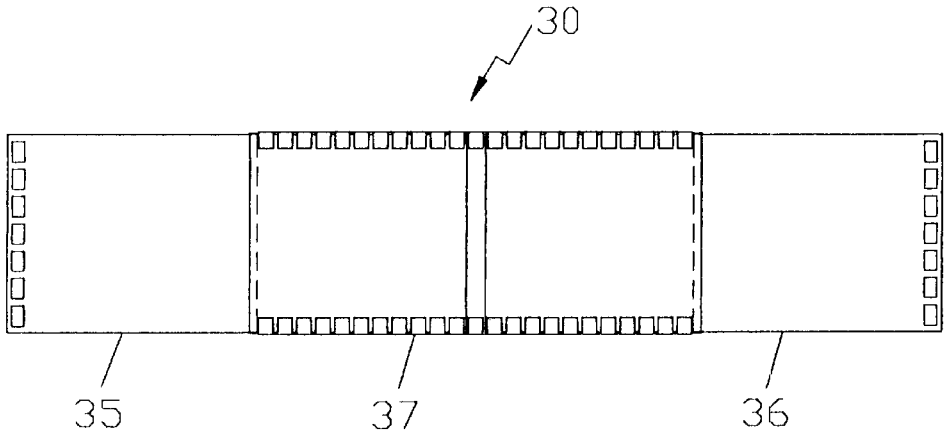
FIG. 8 illustrates a center subassembly of the chimney cover of the present invention.

The side panels 20 and 21 each have an overhanging portion 22 and 23 (FIGS. 5A and 5B), respectively, which are intended to ensure that rain and falling objects do not enter the chimney opening. As shown in FIG. 1, when the chimney cover of the present invention is comprised of two overlapping subassemblies, the overhanging portions of the two subassemblies are positioned opposite one another. In accordance with the preferred embodiment of the present invention, the chimney cover is comprised of at least three subassemblies. The chimney cover preferably is comprised of two end subassemblies and one center subassembly. The two end subassemblies preferably are identical to the subassembly shown in FIGS. 5A and 5B. The center subassembly is shown in FIG. 8. It should be noted that the center subassembly 30, unlike the end subassemblies, does not include overhanging portions. Also, in accordance with this embodiment, the center subassembly 30 is preferably, but not necessarily, somewhat wider than the end subassemblies. In all other respects, the center subassembly is identical to the subassembly shown in FIG. 5A and discussed above. The side panels 35 and 36 slide into the middle panel 37 in the same manner as discussed above with respect to FIGS. 5A and 5B.

Figure 9A:
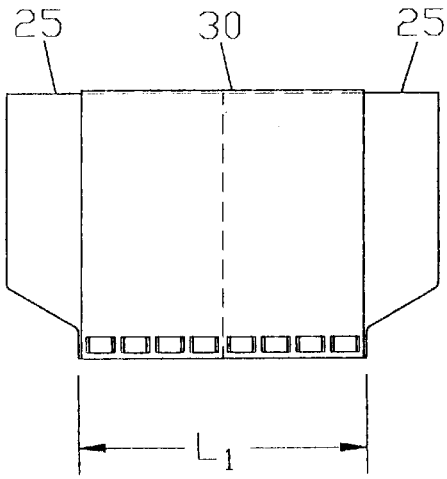
FIG. 9A illustrates a front view of the chimney cover of the present invention comprised of two end subassemblies and one center subassembly.
Figure 9B:
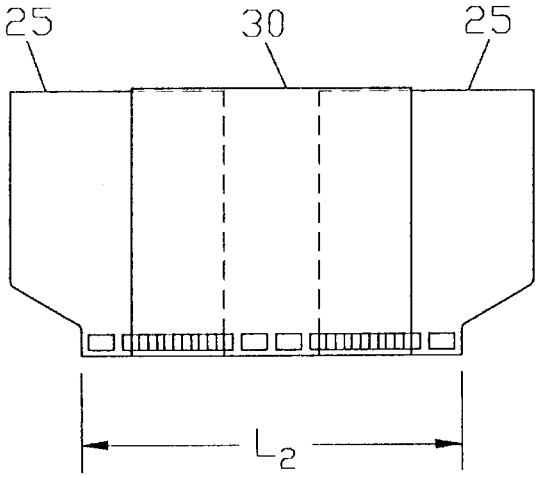
FIG. 9B illustrates a front view of the chimney cover of the present invention wherein the end subassemblies are positioned beneath center subassembly a predetermined distance from one another to form a chimney cover of length $L_2$.

FIG. 9A illustrates a front view of the chimney cover of the present invention comprised of two end subassemblies 25 and one center subassembly 30. FIG. 9A shows the two end subassemblies 25 abutting one another and positioned beneath center subassembly 30 to form a chimney cover of length $L_1$. FIG. 9B illustrates a front view of the chimney cover of the present invention wherein the end subassemblies 25 are positioned beneath center subassembly 30 a predetermined distance from one another to form a chimney cover of length $L_2$. Thus, the chimney cover of FIG. 9B is longer than the chimney cover of FIG. 9A.

Figure 10A:
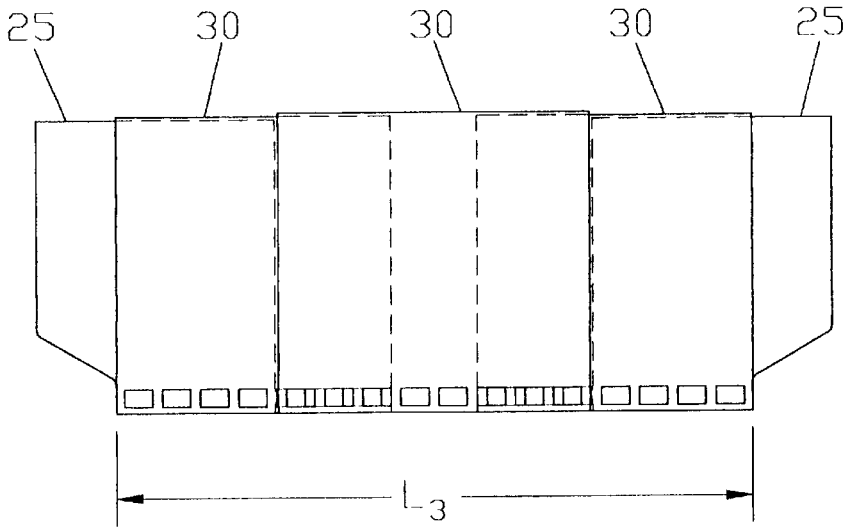
FIG. 10A shows another embodiment of the present invention wherein the chimney cover is comprised of three subassemblies which are identical to the center subassembly shown in FIGS. 9A and 9B and two end subassemblies which are identical to the end subassemblies shown in FIGS. 9A and 9B.
Figure 10B:
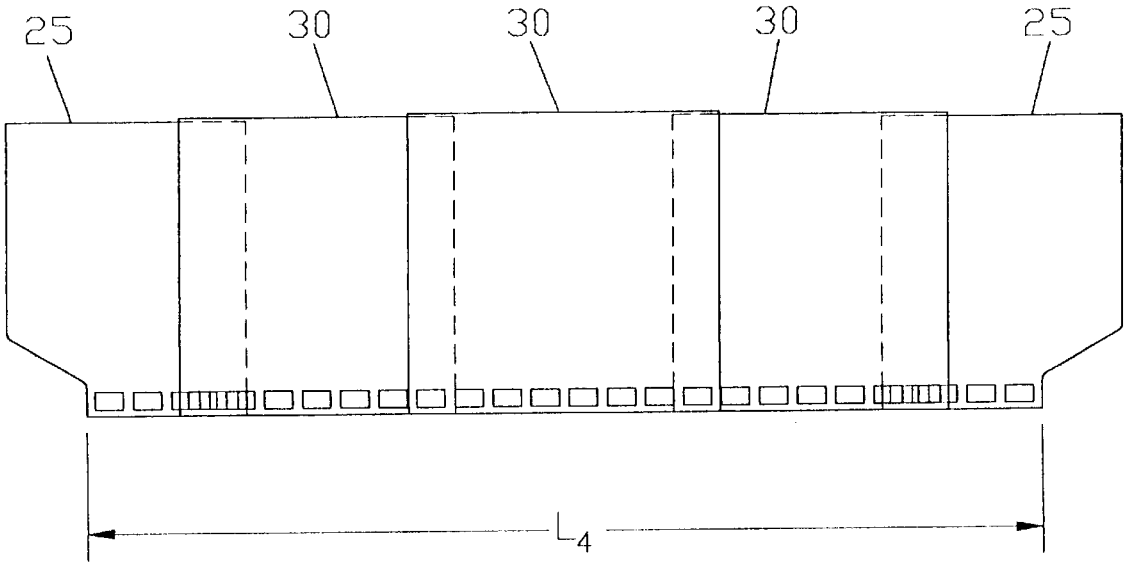
FIG. 10B shows the chimney cover of FIG. 10A in its expanded form.

FIG. 10A shows another embodiment of the present invention wherein the chimney cover is comprised of three subassemblies which are identical to the center subassembly 30 shown in FIGS. 9A and 9B and two end subassemblies which are identical to the end subassemblies 25 shown in FIGS. 9A and 9B. In FIG. 10A, the chimney cover is shown in its unexpanded form, as indicated by the amount of overlap between the subassemblies to accommodate a chimney of length $L_3$. In FIG. 10B, the chimney cover is shown in its expanded form, as indicated by the relatively small amount of overlap between the subassemblies, to accommodate a larger-size chimney of length $L_4$. It will be understood by those skilled in the art that, in accordance with the present invention, any number of subassemblies can be combined to obtain a chimney cover of any desired length. It will also be understood by those skilled in the art that the widths, lengths and relative sizes of the subassemblies themselves can be varied to obtain a chimney cover having a suitable size and suitable mechanical stability. Therefore, the present invention is not limited with respect to size or dimensions. Preferably, the subassemblies are combined to form chimney covers ranging in length from approximately 12 to 38 inches and widths ranging from approximately 18 to 32 inches. However, it will be apparent to those skilled in the art that these sizes are merely intended to accommodate the normal range of chimney sizes and do not constitute limits of the present invention.

Figure 11A:
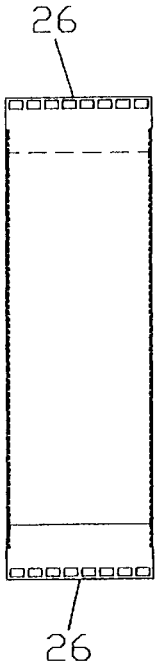
FIGS. 11A and 11B illustrate the subassembly of the present invention in accordance with an alternative embodiment.
Figure 11B:
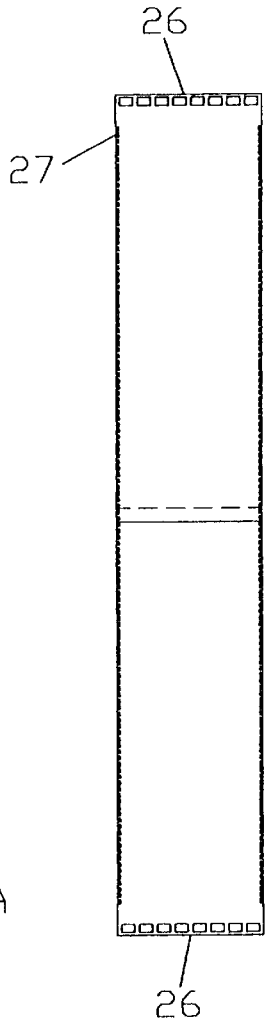

FIG. 11A illustrates an alternative embodiment of the subassembly of the present invention. In accordance with this embodiment, each subassembly is comprised of two side panels 26. No middle panel is needed. Also, there are no tabs on the panels 26. In order to set the length of the panels 26, the panels are placed in an overlapping relationship to achieve the desired length of the subassembly such that the holes 27 in the panels 26 are in alignment and the panels are fastened using nuts and bolts. FIGS. 11A and 11B illustrate two different lengths of subassemblies achieved by fastening the panels 26 together at the desired locations along the panels 26. In accordance with this embodiment, crimping is unnecessary. It will be apparent to those skilled in the art that locking mechanisms, other than nuts and bolts, can be used to fasten the panels 26 together. Other suitable means for fastening the panels 26 together to achieve the desired length include adhesive strips, glue, rivets, clips, weaving a strap or wire through slots similar to the preferred attachment method, locking-pin arrangements, etc. It should be noted that any means for fastening the panels together is suitable for use with the present invention.

Figure 11C:
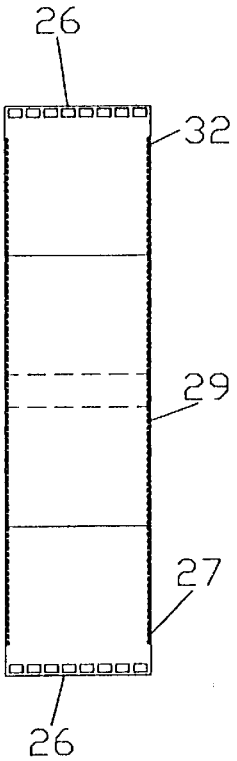
FIGS. 11C and 11D illustrate the subassembly of the present invention in accordance with an alternative embodiment.
Figure 11D:
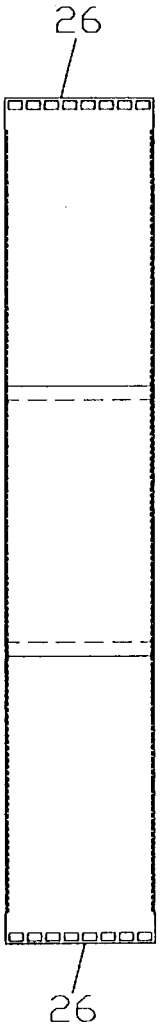
Figure 12A:
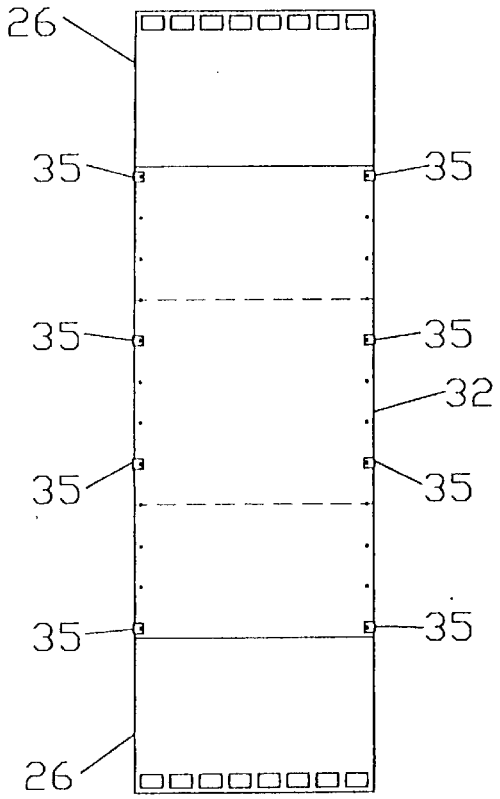
FIGS. 12A and 12B illustrate the subassembly of the present invention in accordance with an alternative embodiment.
Figure 12B:
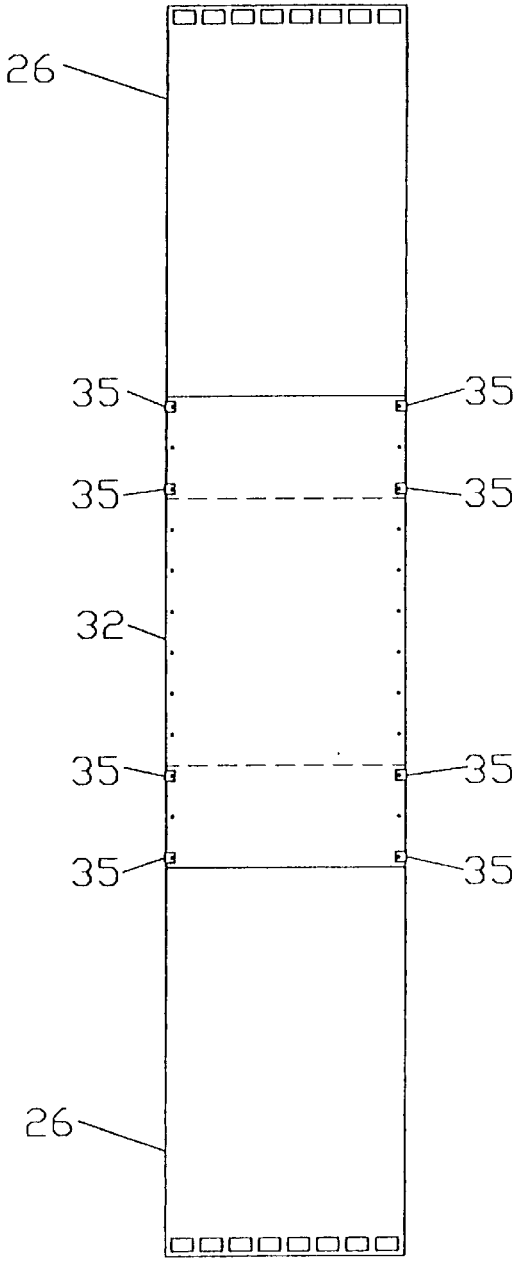

FIGS. 11C and 11D illustrate another alternative embodiment of the subassembly of the present invention. In accordance with this embodiment, two side panels 26 and one middle panel 32 are fastened together to form each subassembly. In order to achieve the desired length for the subassembly, the side panels 26 are placed in an overlapping relationship with the middle panel 32 such that the holes 29 are aligned with the holes 27. The panels are then fastened together, preferably with nuts and bolts. Therefore, crimping is unnecessary. As with the embodiment shown in FIGS. 11A and 11B, any means, such as adhesive strips, glue, rivets, clips, locking-pin arrangements, etc., for fastening the panels together is suitable for use with the present invention. For example, FIGS. 12A and 12B illustrate two side panels 26 which have been fastened to a middle panel 32 with clips 35. As shown in FIGS. 12A and 12B, it is unnecessary for the holes on side panels 26 to be positioned along the entire length of the side panels 26.

Figure 13:
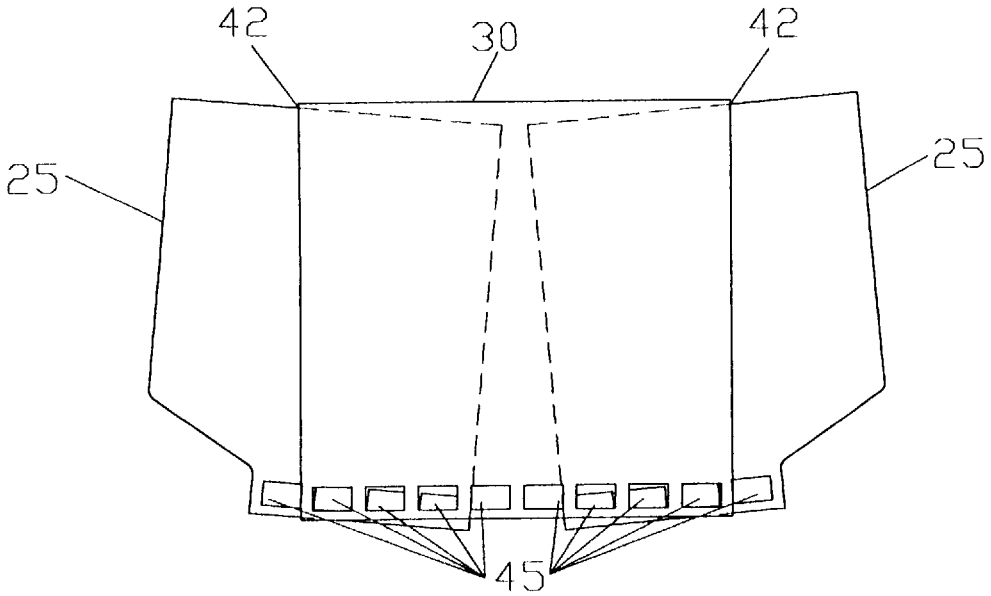
FIG. 13 demonstrates possible problems with leakage if the subassemblies are improperly mounted.
Figure 14:
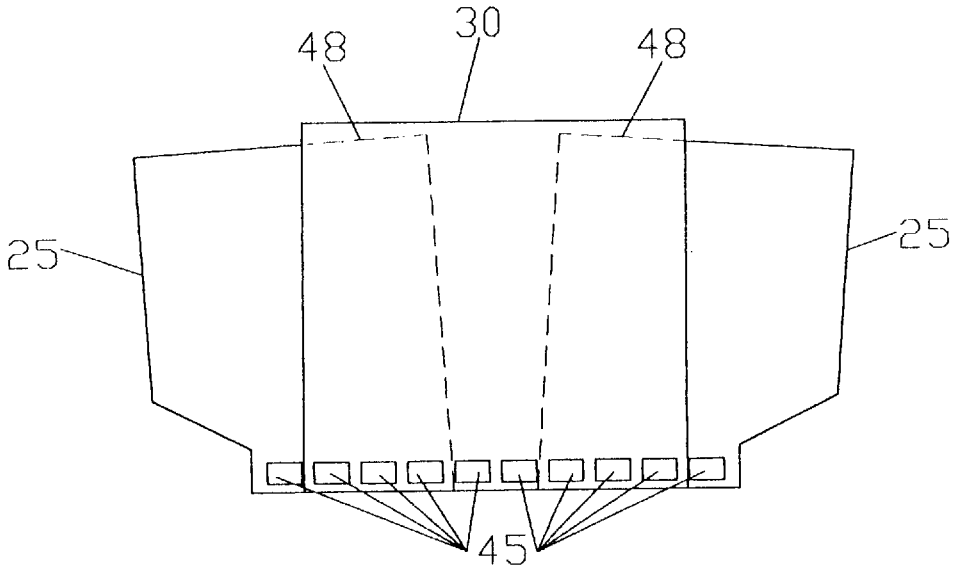
FIG. 14 illustrates subassemblies having offset slots for biasing the subassemblies.
Figure 15:
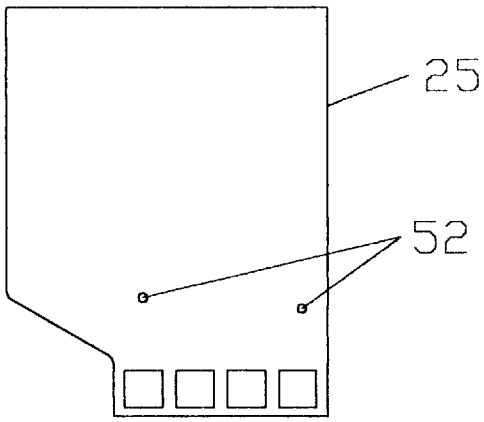
FIG. 15 illustrates an alternative embodiment for biasing the subassemblies.
Figure 16:
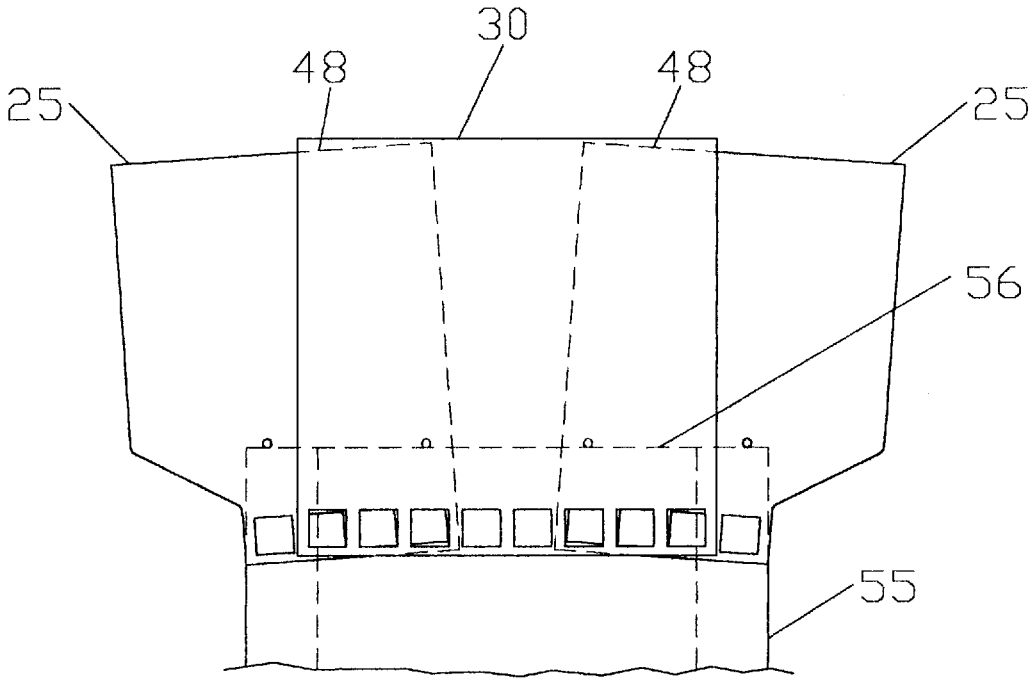
FIG. 16 demonstrates the embodiment shown in FIG. 15.

As shown in FIG. 13, if the subassemblies 25 and 30 are improperly mounted, leaking could occur at the points 42 where the subassemblies overlap. There are several ways to address this issue, the first being to ignore the issue. If the tolerance between the strap (not shown) and the slots 45 is reasonably close, the subassemblies will be sufficiently aligned such that leaking is prevented. Furthermore, the arc formed in the chimney cover in the width-wise direction after the chimney cover has been installed will cause the rain to quickly run off of the chimney cover before it can get inside of top. Alternatively, if desired, a self-adhesive strip of moisture-resistant material may be placed between the overlapping portions of the subassemblies. The strip will act as a dam causing the rain to run off the chimney cover thereby preventing it from getting inside of the top. Yet another way to ensure that leakage is prevented is to manufacture some of the subassemblies at an angle as shown in FIG. 14 so that when the strap is woven through the slots 45, the inner edges 48 of the outer subassemblies 25 will be biased upwardly against the bottom surface of center subassembly 30. Alternatively, this type of bias between the subassemblies can be created by placing bolts (not shown) through holes 52 formed in the end subassemblies 25, as shown in FIG. 15. When the chimney cover is placed on the chimney 55, as shown in FIG. 16, the bolts will rest on the upper surface 56 of the chimney 55 thereby causing the inner edges 48 to be biased upwards against the bottom surface of subassembly 30. It will be apparent to those skilled in the art which one of these methods, if any, should be used under the particular circumstances. However, as stated above, none of these additional steps will need to be taken if the chimney cover of the present invention is properly manufactured and properly installed.

Figure 17:
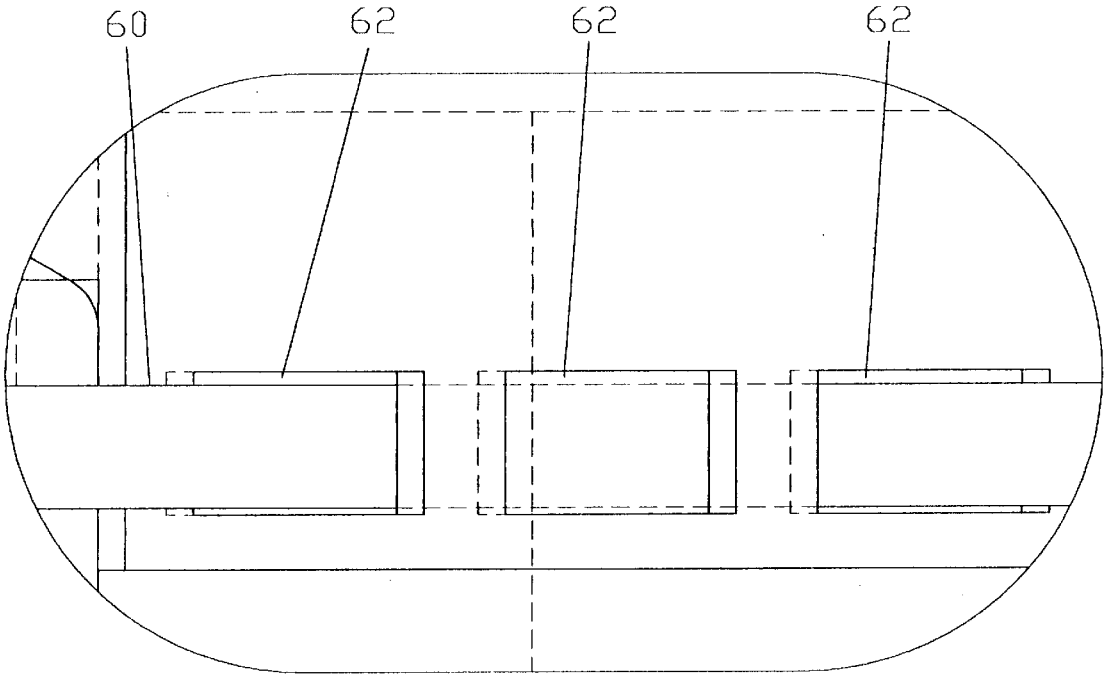
FIG. 17 illustrates a plan view of the chimney cover of the present invention showing a strap woven through the slots formed in the ends of the subassemblies.
Figure 18:
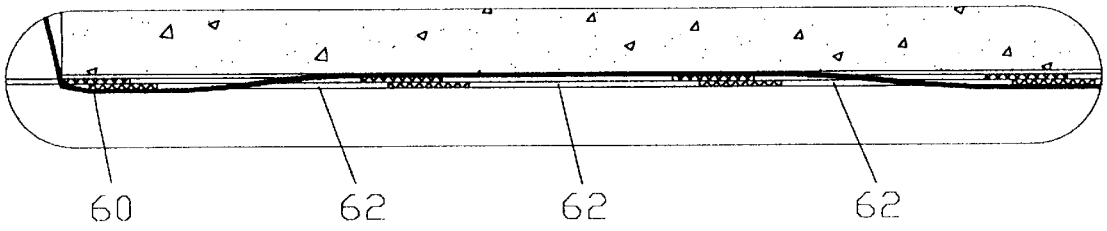
FIG. 18 illustrates a top view of a strap woven through aligned slots in overlapping subassemblies.

FIG. 17 illustrates a plan view of the chimney cover of the present invention showing the strap 60 woven through the slots 62 formed in the ends of the subassemblies. Where the subassemblies do not overlap, the strap 60 can be woven through the slots 62 in a serpentine fashion by weaving the strap 60 into a first slot, out of the adjacent slot, into the next slot and out of the adjacent slot, etc. However, it is not necessary to weave the strap through all of the slots. Where the subassemblies overlap, the strap 60 is woven into and out of the aligned slots in the ends of the overlapping portions of the subassemblies in the same manner discussed above. It is also unnecessary to weave the strap 60 into and out of all of the aligned slots. FIG. 18 illustrates a top view of the strap 60 woven through the aligned slots 62.

Figure 19:
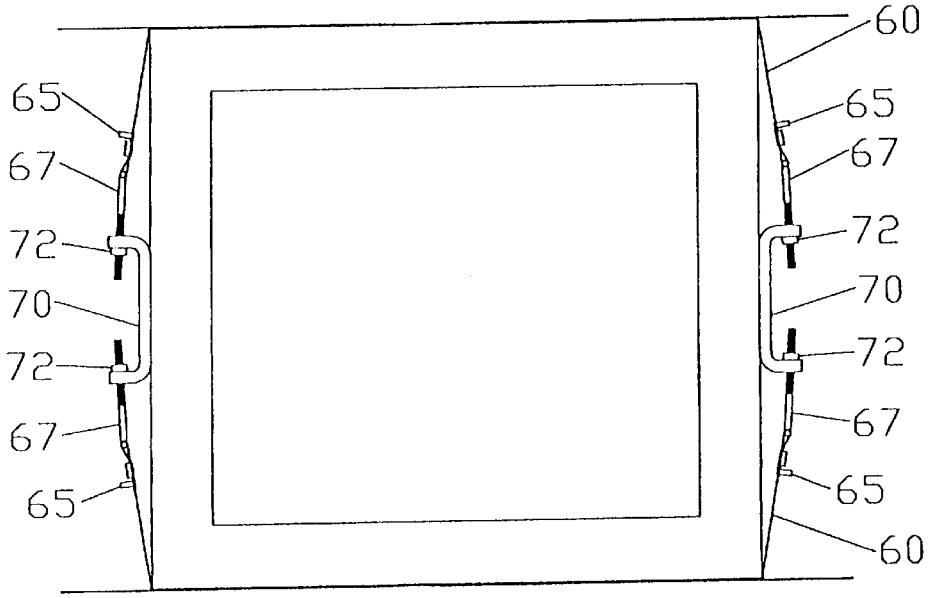
FIG. 19 illustrates a top view of a chimney having the chimney cover of the present invention attached thereto which shows the strap after it has been woven through the slots and attached at its ends to a fastening device.

FIG. 19 illustrates a top view of a chimney having the chimney cover of the present invention attached thereto which shows the strap 60 after it has been woven through the slots (not shown) and attached at its ends to a fastening device. In accordance with the preferred embodiment of the present invention, the fastening device is comprised of four strap clips 65 through which the ends of the strap are looped and crimped, as described in more detail below, four strap holders 67 through which the ends of the strap are passed around to form the loops prior to crimping the strap clips 65 on the loop ends, two strap holder brackets 70, each having two bore holes formed therein for receiving the threaded ends of the strap holders 67, and four nuts 72 which are threaded onto the ends of the strap holders 67. Once the ends of the strap have been passed through the strap clips 65, around the ends of the strap holders 67, back through the strap clips 65, and the strap clips 65 have been crimped, the threaded ends of the strap holders 67 are passed through the bore holes in the strap holder brackets 70. The nuts 72 are then threaded about the threaded ends of the strap holders 67 and tightened. It should be noted that, although it is preferred that two straps be used to secure the chimney cover of the present invention to the chimney top and to fasten the subassemblies together, alternatively, one strap may be used. In this case, the fastening hardware can be reduced to two strap clips 65, two strap holders 67, one strap holder bracket 70 and two nuts 72.

Figure 21B:
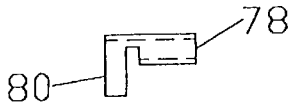
FIG. 21B illustrates a side view of the strap clip shown in FIG. 20.
Figure 20:
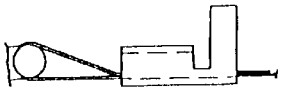
FIG. 20 illustrates a top view of the looped end of the strap passed around the end of the strap holder and back through the strap clip prior to crimping the strap clip.
Figure 21A:
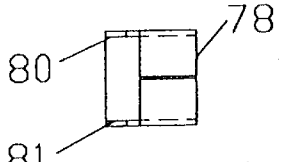
FIG. 21A illustrates a plan view of the strap clip shown in FIG. 20.
Figure 21C:
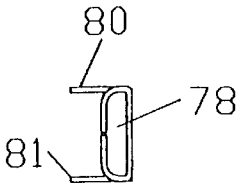
FIG. 21C illustrates a top view of the strap clip shown in FIG. 20.
Figure 22B:
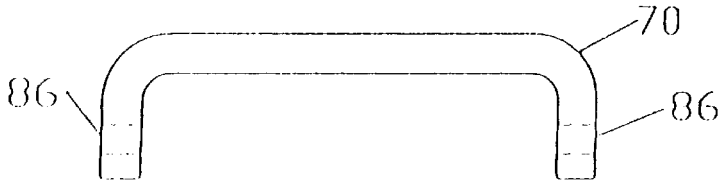
FIG. 22B illustrates a bottom plan view of the strap holder bracket shown in FIG. 20.
Figure 22A:
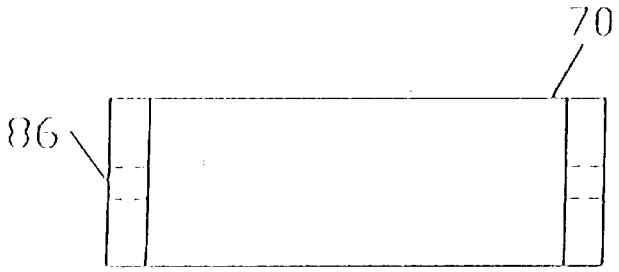
FIG. 22A illustrates a top view of the strap holder bracket shown in FIG. 20.
Figure 22C:
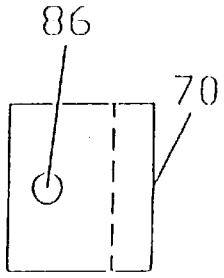
FIG. 22C illustrates a side view of the strap holder bracket shown in FIG. 20.
Figure 23B:
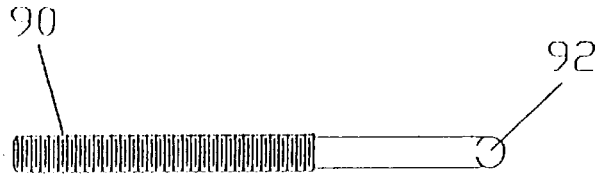
FIGS. 23A, 23B, and 23C illustrate several views of the bolt which is inserted through the strap holder bracket of FIG. 22.
Figure 23A:
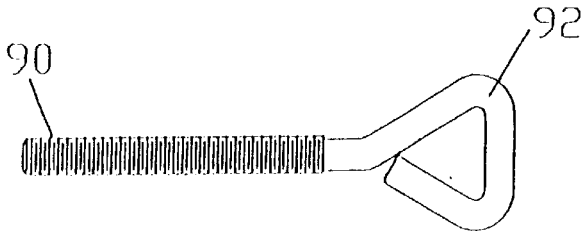
Figure 23C:
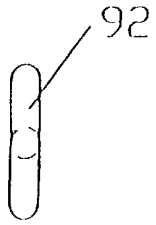

FIG. 20 illustrates a top view of the looped end of the strap passed around the end of the strap holder 67 and back through the strap clip 65 prior to crimping the strap clip 65. FIG. 21A illustrates a plan view of the strap clip 65. FIG. 21B illustrates a side view of the strap clip 65. FIG. 21C illustrates a top view of the strap clip 65. The strap ends pass through the opening 78 in the strap clip 65 and the crimping arms 80 and 81 are crimped onto the strap ends to prevent them from pulling away from the strap clip 65. FIG. 22A illustrates a bottom plan view of the strap holder bracket 70 having bore holes 86 formed in the sides thereof FIG. 22B illustrates a top view of the strap holder bracket 70. FIG. 22C illustrates a side view of the strap holder bracket 70. FIG. 23 illustrates several views of the strap holder 67. The strap holder 67 has a threaded end 90 for receiving the nut 72 in threaded engagement therewith. The strap holder 67 has a head 92 with an opening therein for receiving the strap 60.

It will be apparent to those skilled in the art that the embodiments of the present invention discussed above are illustrative embodiments of the present invention and that the present invention is not limited to those embodiments. For example, it should be noted that the fastening device, the slots in the ends of the subassemblies and the strap discussed above are only one of many possible apparatuses which may be implemented for securing the chimney cover of the present invention to a chimney. It will be apparent to those skilled in the art that the present invention is not limited with respect to the apparatus used for securing the chimney cover to the chimney. It will be apparent to those skilled in the art that other modifications may be made to the embodiments discussed above without deviating from the spirit and scope of the present invention.

What is claimed is:

1. An adjustable chimney cover comprising:

a first subassembly comprising first and second side panels;

a second subassembly comprising third and fourth side panels;

means for locking said first and second side panels together at a location where said first and second side panels overlap to achieve an overall length of said first subassembly;

means for locking said third and fourth side panels together at a location where said third and fourth side panels overlap to achieve an overall length of said second subassembly, wherein the length of said second subassembly is approximately equal to the overall length of said first subassembly; and means for fastening said first and second subassemblies to a chimney top such that said first and second subassemblies are placed in a partially overlapping relationship with one another to form a chimney cover having a length approximately equal to the width of the overlapping subassemblies.

2. The chimney cover of claim 1 further comprising:

a third subassembly, said third subassembly comprising fifth and sixth side panels;

means for locking said fifth and sixth side panels together at a location where said fifth and sixth side panels overlap to achieve an overall length of said third subassembly, wherein the length of said third subassembly is approximately equal to the overall length of said first subassembly; and means for fastening said third subassembly to said first and second subassemblies and to a chimney top such that said first, second and third subassemblies are placed in a partially overlapping relationship with one another to form a chimney cover having a length approximately equal to the width of said overlapping first, second and third subassemblies.

3. The chimney cover of claim 1 wherein said side panels are fastened together with nuts and bolts.

4. The chimney cover of claim 1 wherein said side panels are fastened together with adhesive.

5. The chimney cover of claim 1 wherein said side panels are fastened together with clips.

6. The chimney cover of claim 1 wherein said side panels are fastened together with locking pins.

7. The chimney cover of claim 1 wherein the amount of overlap between said subassemblies can be adjusted to vary the length of said chimney cover.

8. The chimney cover of claim 1 wherein each of said side panels has a first end and a second end and wherein said second ends of said side panels are attached to the second ends of adjacent side panels by said fastening means, and wherein said fastening means comprises a strap which is woven through slots located in said second ends of said side panels after said second ends of said side panels have been disposed about a chimney top, and wherein said strap has first and second ends and wherein the first and second ends of said strap are attached to a fastening device comprised by said fastening means, wherein said fastening device can be adjusted to tighten the strap about the chimney.

9. An adjustable chimney cover comprising:

a first subassembly comprising a middle panel and two side panels, said side panels being movably mounted within said middle panel to allow said side panels to be adjusted in first and second directions within said middle panel by sliding said side panels in said first and second directions, wherein an overall length of said first subassembly is adjusted by sliding said side panels in said first or second directions within said middle panel, said first subassembly further comprising a locking mechanism for locking said first and second side panels in position once said first and second side panels have been adjusted to obtain a desired overall length of said first subassembly; and a second subassembly comprising a middle panel and two side panels, said side panels of said second subassembly being movably mounted within said middle panel of said second subassembly to allow said side panels of said second subassembly to be adjusted in first and second directions within said middle panel of said second subassembly by sliding said side panels of said second subassembly in said first and second directions, wherein an overall length of said second subassembly is adjusted by sliding said side panels of said second subassembly in said first or second directions within said middle panel of said second subassembly, said second subassembly further comprising a locking mechanism for locking said first and second side panels of said second subassembly in position once said first and second side panels of said second subassembly have been adjusted to obtain a desired overall length of said second subassembly, wherein said overall length of said second subassembly is substantially equal to said overall length of said first subassembly, and wherein said first and second subassemblies, when placed in an overlapping relationship, form a chimney cover having a length L which can be attached to a chimney to cover a chimney opening in said chimney.

10. The chimney cover of claim 9 further comprising a third subassembly, said third subassembly comprising a middle panel and two side panels, said side panels of said third subassembly being movably mounted within said middle panel of said third subassembly to allow said side panels of said third subassembly to be adjusted in first and second directions within said middle panel of said third subassembly by sliding said side panels of said third subassembly in said first and second directions, wherein an overall length of said third subassembly is adjusted by sliding said side panels of said third subassembly in said first or second directions within said middle panel of said third subassembly, said third subassembly further comprising a locking mechanism for locking said first and second side panels of said third subassembly in position once said first and second side panels of said third subassembly have been adjusted to obtain a desired overall length of said third subassembly, wherein said overall length of said third subassembly is substantially equal to said overall length of said first and second subassemblies, and wherein said first, second and third subassemblies, when placed in an overlapping relationship, form a chimney cover having a length $L_2$ which is greater than length $L_1$, and wherein said chimney cover having length $L_2$ can be attached to a chimney to cover a chimney opening in said chimney.

11. The chimney cover of claim 9 wherein each of said side panels has a first end and a second end and wherein said first ends of said side panels slide into said middle panels and wherein said second ends of said side panels are attached to adjacent side panels and to a chimney by an attaching apparatus.

12. The chimney cover of claim 9 wherein the amount of overlap between said subassemblies can be adjusted to vary the length of said chimney cover.

13. The chimney cover of claim 9 wherein each of said side panels has a first end and a second end and wherein said first ends of said side panels slide into said middle panels and wherein said second ends of said side panels have slots formed therein and wherein said second ends of said side panels are attached to the second ends of adjacent side panels by a strap which is woven through the slots in said second ends of said side panels after said second ends of said side panels have been disposed about a chimney, and wherein said strap has first and second ends and wherein the first and second ends of said strap are attached to a fastening device which can be adjusted to tighten the strap about the chimney.

14. The chimney cover of claim 10 further comprising a fourth subassembly, said fourth subassembly comprising a middle panel and two side panels, said side panels of said fourth subassembly being movably mounted within said middle panel of said fourth subassembly to allow said side panels of said fourth subassembly to be adjusted in first and second directions within said middle panel of said fourth subassembly by sliding said side panels of said fourth subassembly in said first and second directions, wherein an overall length of said fourth subassembly is adjusted by sliding said side panels of said fourth subassembly in said first or second directions within said middle panel of said fourth subassembly, said fourth subassembly further comprising a locking mechanism for locking said first and second side panels of said fourth subassembly in position once said first and second side panels of said fourth subassembly have been adjusted to obtain a desired overall length of said fourth subassembly, wherein said overall length of said fourth subassembly is substantially equal to said overall length of said first, second and third subassemblies, and wherein said first, second, third and fourth subassemblies, when placed in an overlapping relationship, form a chimney cover having a length $L_3$ which is greater than length $L_2$, and wherein said chimney cover having length $L_3$ can be attached to a chimney to cover a chimney opening in said chimney.

15. The chimney cover of claim 10 wherein each of said side panels has a first end and a second end and wherein said first ends of said side panels slide into said middle panels and wherein said second ends of said side panels are attached to adjacent side panels and to a chimney by an attaching apparatus.

16. The chimney cover of claim 10 wherein the amount of overlap between said subassemblies can be adjusted to vary the length of said chimney cover.

17. The chimney cover of claim 10 wherein each of said side panels has a first end and a second end and wherein said first ends of said side panels slide into said middle panels and wherein said second ends of said side panels have slots formed therein and wherein said second ends of said side panels are attached to the second ends of adjacent side panels by a strap which is woven through the slots in said second ends of said side panels after said second ends of said side panels have been disposed about a chimney, and wherein said strap has first and second ends and wherein the first and second ends of said strap are attached to a fastening device which can be adjusted to tighten the strap about the chimney.

18. The chimney cover of claim 12 wherein each of said side panels has a first end and a second end and wherein said first ends of said side panels slide into said middle panels and wherein said second ends of said side panels have slots formed therein and wherein said second ends of said side panels are attached to the second ends of adjacent side panels by a strap which is woven through the slots in said second ends of said side panels after said second ends of said side panels have been disposed about a chimney, and wherein said strap has first and second ends and wherein the first and second ends of said strap are attached to a fastening device which can be adjusted to tighten the strap about the chimney.

19. The chimney cover of claim 13 wherein each of said side panels has a first end and a second end and wherein said first ends of said side panels slide into said middle panels and wherein said second ends of said side panels have slots formed therein and wherein said second ends of said side panels are attached to the second ends of adjacent side panels by a strap which is woven through the slots in said second ends of said side panels after said second ends of said side panels have been disposed about a chimney, and wherein said strap has first and second ends and wherein the first and second ends of said strap are attached to a fastening device which can be adjusted to tighten the strap about the chimney.

20. The chimney cover of claim 14 wherein each of said side panels has a first end and a second end and wherein said first ends of said side panels slide into said middle panels and wherein said second ends of said side panels are attached to adjacent side panels and to a chimney by an attaching apparatus.

21. The chimney cover of claim 14 wherein each of said side panels has a first end and a second end and wherein said first ends of said side panels slide into said middle panels and wherein said second ends of said side panels have slots formed therein and wherein said second ends of said side panels are attached to the second ends of adjacent side panels by a strap which is woven through the slots in said second ends of said side panels after said second ends of said side panels have been disposed about a chimney, and wherein said strap has first and second ends and wherein the first and second ends of said strap are attached to a fastening device which can be adjusted to tighten the strap about the chimney.

22. The chimney cover of claim 14 wherein the amount of overlap between said subassemblies can be adjusted to vary the length of said chimney cover.

23. The chimney cover of claim 19 wherein each of said side panels has a first end and a second end and wherein said first ends of said side panels slide into said middle panels and wherein said second ends of said side panels have slots formed therein and wherein said second ends of said side panels are attached to the second ends of adjacent side panels by a strap which is woven through the slots in said second ends of said side panels after said second ends of said side panels have been disposed about a chimney, and wherein said strap has first and second ends and wherein the first and second ends of said strap are attached to a fastening device which can be adjusted to tighten the strap about the chimney.

* * * * *